US006179591B1

(12) United States Patent
Clendenin et al.

(10) Patent No.: US 6,179,591 B1
(45) Date of Patent: Jan. 30, 2001

(54) CONICAL HUB BEARING FOR SCROLL MACHINE

(75) Inventors: Harry Clendenin, Sidney, OH (US); James E. Gundermann, Warren, PA (US); Ram Vittal, Sidney, OH (US)

(73) Assignee: Copeland Corporation, Sidney, OH (US)

( * ) Notice: Under 35 U.S.C. 154(b), the term of this patent shall be extended for 0 days.

(21) Appl. No.: 09/431,191

(22) Filed: Nov. 1, 1999

(51) Int. Cl.[7] ..... F01C 1/02
(52) U.S. Cl. ..... 418/55.1
(58) Field of Search ..... 418/55.1

(56) References Cited

U.S. PATENT DOCUMENTS

| | | | | |
|---|---|---|---|---|
| 4,473,343 | * | 9/1984 | Hazaki et al. | 418/55.1 |
| 5,320,507 | * | 6/1994 | Monnier et al. | 418/55.6 |
| 5,474,431 | * | 12/1995 | Fairbanks | 418/55.1 |
| 5,489,198 | * | 2/1996 | Comparin et al. | 418/55.1 |
| 5,545,019 | * | 8/1996 | Beck et al. | 418/55.1 |
| 5,582,511 | * | 12/1996 | Fairbanks | 418/55.1 |
| 5,593,294 | * | 1/1997 | Houghtby et al. | 418/55.1 |

FOREIGN PATENT DOCUMENTS

| | | | | |
|---|---|---|---|---|
| 537884 | * | 4/1993 | (EP) | 418/55.1 |
| 60-098184 | * | 6/1985 | (JP) | 418/55.1 |
| 63-001783 | * | 1/1988 | (JP) | 418/55.1 |
| 1-267382 | * | 10/1989 | (JP) | 418/55.1 |
| 3-237283 | * | 10/1991 | (JP) | 418/55.1 |
| 4-284193 | * | 10/1992 | (JP) | 418/55.1 |
| 5-141370 | * | 6/1993 | (JP) | 418/55.1 |
| 5-195967 | * | 8/1993 | (JP) | 418/55.1 |
| 5-240172 | * | 9/1993 | (JP) | 418/55.1 |
| 58-148291 | * | 9/1993 | (JP) | 418/55.1 |

* cited by examiner

*Primary Examiner*—Thomas Denion
*Assistant Examiner*—Theresa Trieu
(74) *Attorney, Agent, or Firm*—Harness, Dickey & Pierce, P.L.C.

(57) ABSTRACT

A scroll compressor has an orbiting scroll which has an end plate with a hub extending generally perpendicular from the end plate. The hub defines a bore within which a bearing is press fit. The machining of the bore in the hub is done in a conical manner to accommodate and compensate for the unequal distortion of the hub between the two ends of the hub. The conical shape and the unequal distortion provide an assembled bearing with a more cylindrically shaped inner surface.

12 Claims, 2 Drawing Sheets

CONICAL HUB BEARING FOR SCROLL MACHINE

FIELD OF THE INVENTION

The present invention relates to scroll machines. More particularly, the present invention relates to scroll compressors having a conical shaped bore in the hub into which the bearing is pressed. After insertion of the bearing, the conical shape of the bore in conjunction with the variation in distortion of the hub provides a straight bearing for the compressor.

BACKGROUND AND SUMMARY OF THE INVENTION

Scroll type machines are becoming more and more popular for use as compressors in both refrigeration as well as air conditioning applications due primarily to their capability for extremely efficient operation. Generally, these machines incorporate a pair of intermeshed spiral wraps one of which is caused to orbit relative to the other so as to define one or more moving chambers which progressively decrease in size as they travel from an outer suction port toward a center discharge port. An electric motor is provided which operates to drive the orbiting scroll member via a suitable drive shaft affixed to the motor rotor. In a hermetic compressor, the bottom of the hermetic shell normally contains an oil sump for lubricating and cooling purposes.

Generally, the motor includes a stator which is secured to the shell of the compressor. The motor rotor rotates within the stator to impart rotation to a crankshaft which is normally press fit within the motor rotor. The crankshaft is rotationally supported by a pair of bearings which are supported by an upper bearing housing and a lower bearing housing. The crankshaft includes an eccentric crank pin which extends into a bore defined in a hub of the orbiting scroll. Disposed between the hub of the crank pin and the inner surface of the bore is a drive bushing which rides against a bearing that is press fit within the bore of the hub.

The hub of the orbiting scroll extends perpendicularly from a base plate of the orbiting scroll. The bore in the hub extends from the open end of the hub to a position generally adjacent the base plate of the orbiting scroll. Thus, the bore in the hub is a blind bore with the open end being positioned at the distal end of the hub and the closed end being positioned at the base plate of the orbiting scroll. During the manufacture of the orbiting scroll, the bore in the hub is machined and the bearing is press fit within the machined bore. Because of the press fit relationship of the bearing and the bore, both the scroll hub and the bearing will deflect during the assembly of the bearing. The total amount of deflection will be determined by the overall stiffness of the hub. The deflection of the hub at the open end of the bore will be greater than the deflection of the hub at the closed end of the bore. The main reason for this unequal deflection is because the hub at the open end of the bore is unsupported while the hub at the closed end of the bore is supported by the end plate. The unequal deflection will result in an assembled bearing having a greater diameter at the open end than at the closed end. This tapered bearing will adversely affect the long term performance of the bearing life and thus the scroll machine.

The present invention presents a solution to the tapered bearing problem by providing a conical bearing bore prior to the installation of the bearing. The conical shape of the bearing bore provides a smaller diameter at the open end and a larger diameter at the closed end. After assembly of the bearing the unequal deflection of the scroll hub will provide an assembled bearing that is more cylindrical than the prior art systems. Thus, the more cylindrical shape will perform longer thus increasing the long term durability of both the bearing and the compressor. The more cylindrical shape increases the durability by providing a uniform clearance between the bearing and the bushing. The uniform clearance increases the load capacity of the bearing due to more uniform pressures being exerted on the bearing. Other advantages include a more uniform press load is required to assemble the bearing and this uniform press load provides a better indication of the holding pressure of the assembly. In addition, the system of the present invention is less sensitive to the dimensional variations of the individual components and this will therefore allow some broadening of the tolerances of the individual dimensions.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
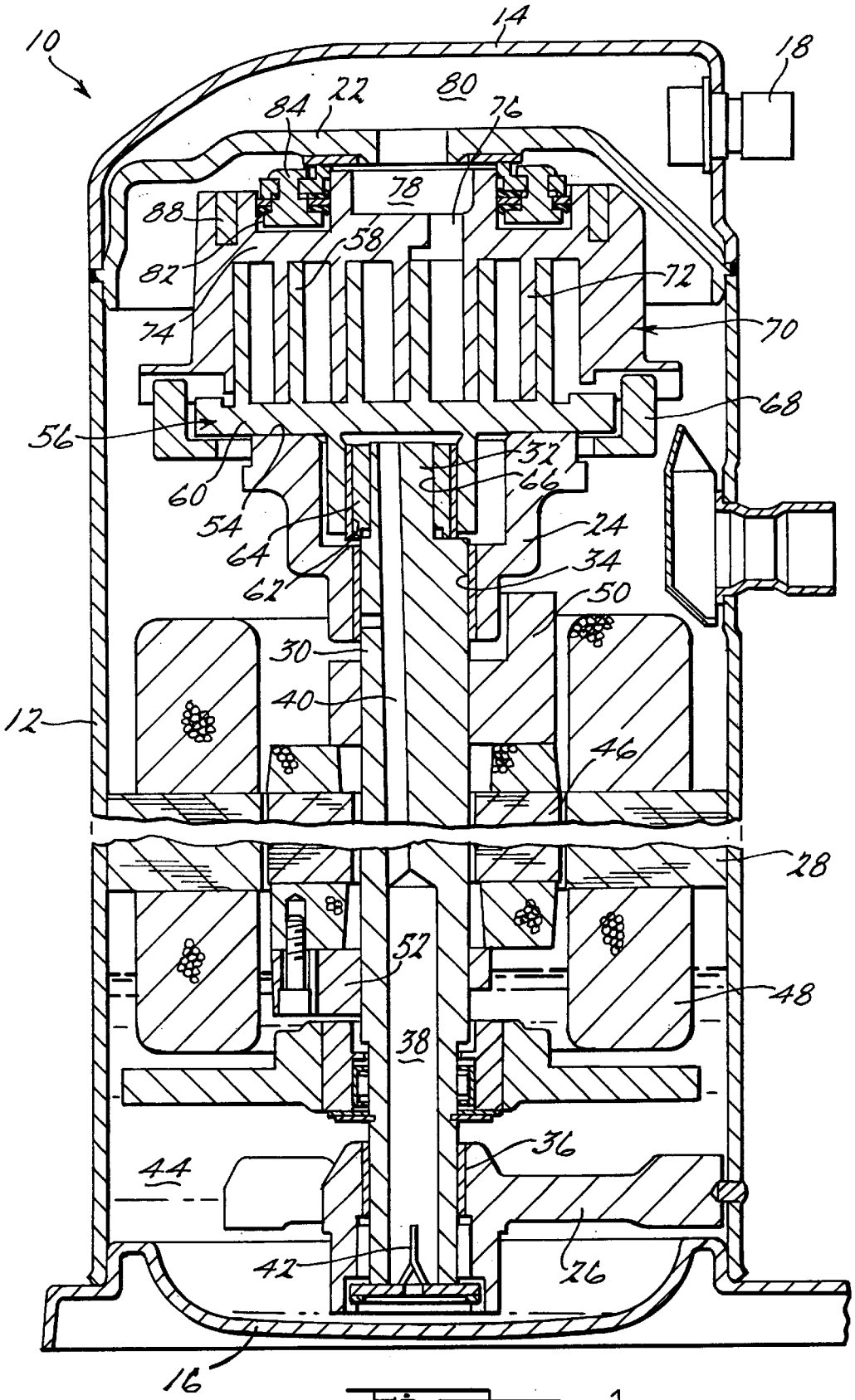
FIG. 1 is a vertical cross-sectional view through the center of a scroll type refrigeration compressor incorporating the conical hub bearing in accordance with the present invention.

Referring now to the drawings in which like reference numerals designate like or corresponding parts throughout the several views, there is shown in FIG. 1 a scroll compressor which incorporates a compensation system in accordance with the present invention which is designated generally by reference numeral 10. Compressor 10 comprises a generally cylindrical hermetic shell 12 having welded at the upper end thereof a cap 14 and at the lower end thereof a base 16 having a plurality of mounting feet (not shown) integrally formed therewith. Cap 14 is provided with a refrigerant discharge fitting 18 which may have the usual discharge valve therein (not shown). Other major elements affixed to the shell include a transversely extending partition 22 which is welded about its periphery at the same point that cap 14 is welded to shell 12, a main bearing housing 24 which is suitably secured to shell 12 by a plurality of radially outwardly extending legs and a lower bearing housing 26 also having a plurality of radially outwardly extending legs each of which is also suitably secured to shell 12. A motor stator 28 which is generally square or hexagonal in cross-section but with the corners rounded off is press fitted into shell 12. The flats between the rounded corners on stator 28 provide passageways between stator 28 and shell 12, which facilitate the return flow of lubricant from the top of the shell to the bottom.

A drive shaft or crankshaft 30 having an eccentric crank pin 32 at the upper end thereof is rotatably journaled in a bearing 34 in main bearing housing 24 and a second bearing 36 in lower bearing housing 26. Crankshaft 30 has at the lower end a relatively large diameter concentric bore 38 which communicates with a radially outwardly inclined smaller diameter bore 40 extending upwardly therefrom to the top of crankshaft 30. Disposed within bore 38 is a stirrer 42. The lower portion of the interior shell 12 defines an oil sump 44 which is filled with lubricating oil to a level slightly above the lower end of a rotor 46, and bore 38 acts as a pump to pump lubricating fluid up the crankshaft 30 and into bore 40 and ultimately to all of the various portions of the compressor which require lubrication.

Crankshaft 30 is rotatively driven by an electric motor including stator 28, windings 48 passing therethrough and rotor 46 press fitted on crankshaft 30 and having upper and lower counterweights 50 and 52, respectively.

The upper surface of main bearing housing 24 is provided with a flat thrust bearing surface 54 on which is disposed an orbiting scroll member 56 having the usual spiral vane or wrap 58 extending upward from an end plate 60. Projecting downwardly from the lower surface of end plate 60 of orbiting scroll member 56 is a cylindrical hub having a journal bearing 62 therein and in which is rotatively disposed a drive bushing 64 having an inner bore 66 in which crank pin 32 is drivingly disposed. Crank pin 32 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 68 is also provided positioned between orbiting scroll member 56 and bearing housing 24 and keyed to orbiting scroll member 56 and a non-orbiting scroll member 70 to prevent rotational movement of orbiting scroll member 56. Oldham coupling 68 is preferably of the type disclosed in assignee's co-pending U.S. Pat. No. 5,320,506, the disclosure of which is hereby incorporated herein by reference.

Non-orbiting scroll member 70 is also provided having a wrap 72 extending downwardly from an end plate 74 which is positioned in meshing engagement with wrap 58 of orbiting scroll member 56. Non-orbiting scroll member 70 has a centrally disposed discharge passage 76 which communicates with an upwardly open recess 78 which in turn is in fluid communication with a discharge muffler chamber 80 defined by cap 14 and partition 22. An annular recess 82 is also formed in non-orbiting scroll member 70 within which is disposed a seal assembly 84. Recesses 78 and 82 and seal assembly 84 cooperate to define axial pressure biasing chambers which receive pressurized fluid being compressed by wraps 58 and 72 so as to exert an axial biasing force on non-orbiting scroll member 70 to thereby urge the tips of respective wraps 58, 72 into sealing engagement with the opposed end plate surfaces of end plates 74 and 60, respectively. Seal assembly 84 is preferably of the type described in greater detail in U.S. Pat. No. 5,156,539, the disclosure of which is hereby incorporated herein by reference. Non-orbiting scroll member 70 is designed to be mounted to bearing housing 24 in a suitable manner such as disclosed in the aforementioned U.S. Pat. No. 4,877,382 or U.S. Pat. No. 5,102,316, the disclosure of which is hereby incorporated herein by reference.

Figure 2:
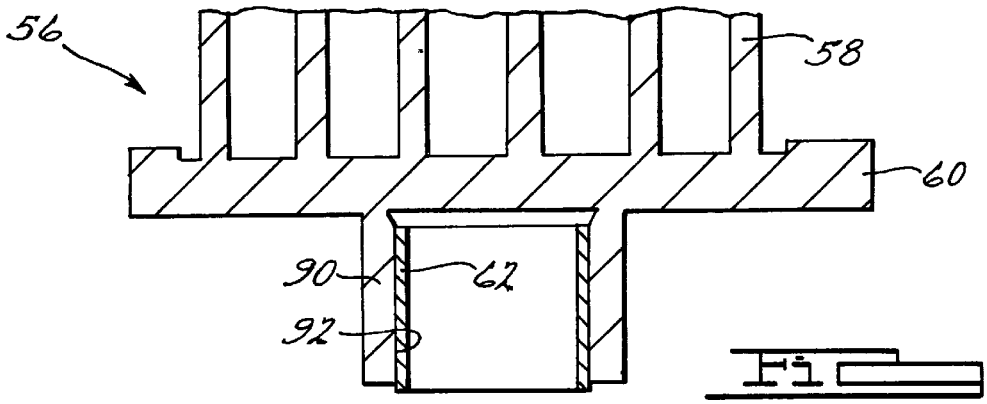
FIG. 2 is an enlarged cross-sectional view of the orbiting scroll hub and bearing of the compressor shown in FIG. 1.
Figure 3:
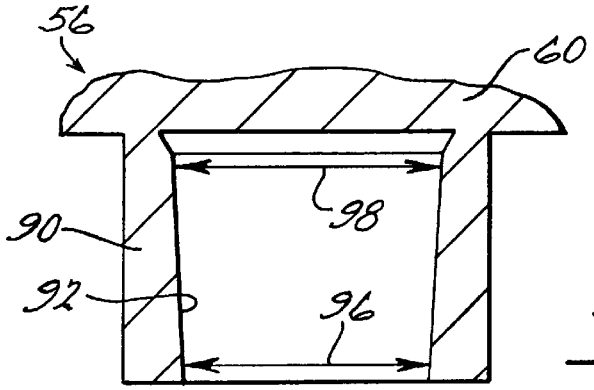
FIG. 3 is an enlarged cross-sectional view of the orbiting scroll hub shown in FIGS. 1 and 2 prior to assembly of the bearing illustrating the conical hub bore according to the present invention.

Referring now to FIGS. 2 and 3, the hub of orbiting scroll member 56 includes annular wall 90 which extends generally perpendicularly from end plate 60. Annular wall 90 defines an internal bore 92 within which bearing 62 is located. The manufacturing process for orbiting scroll member 56 includes the machining of bore 92 and the assembly of bearing 62 within bore 92. The dimensions for bore 92 and the dimensions for bearing 62 are chosen such that an interference fit occurs between the outside diameter of bearing 62 and the inside diameter of bore 92. Typically, the amount of interference designed into the assembly is 0.003 inches when scroll member 56 and bearing 62 are manufactured from steel. Of course the amount of interference will change when scroll member 56 is made from a different material. These dimensions are typical for a bore diameter of approximately 30 mm for bore 92.

During the assembly of bearing 62 within bore 92 both annular wall 90 and bearing 62 will deflect due to the interference fit. Typically, a steel or cast iron scroll member 56 will see annular wall 90 deflecting outward approximately 40% of the interference and bearing 62 will deflect inward approximately 60% of the interference. The relationship between the amount of deflection will change when scroll member 56 is manufactured from a different material.

Referring to FIG. 3, bore 92 is illustrated. Bore 92 includes a first diameter 96 at its open end and a second diameter 98 at its closed end. The shape of bore 92 between diameters 96 and 98 is a straight line relationship and diameter 96 is smaller than diameter 98. Preferably, the difference between diameter 96 and diameter 98 is between 0.0010 inches and 0.0012 inches.

Figure 4:
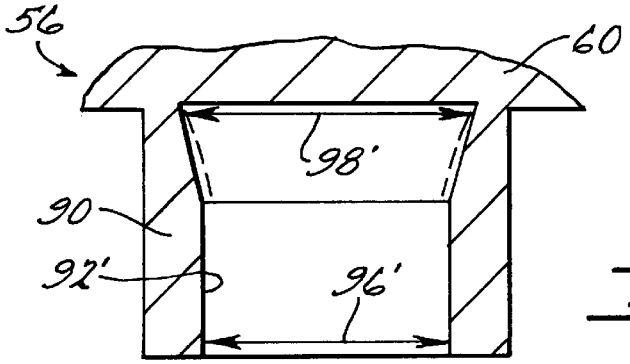
FIG. 4 is an enlarged cross-sectional view similar to FIG. 3 but illustrating a conical hub bore in accordance with another embodiment of the present invention.

Referring to FIG. 4, a bore 92' is illustrated. Bore 92' includes a first diameter 96' at its open end and a second diameter 98' at its closed end. The shape of bore 92' between diameters 96' and 98' is defined by diameter 96' extending towards diameter 98' for a specified distance and then a straight line relationship as shown in a solid line or a curved relationship as shown in a dashed line between diameter 96' and 98'. Diameter 96' is smaller than diameter 98'. Preferably the difference between diameter 96' and diameter 98' is between 0.0006 inches and 0.0012 inches with diameter 96' extending for approximately 60% of the length between the free end and the closed end of bore 92'.

Figure 5:
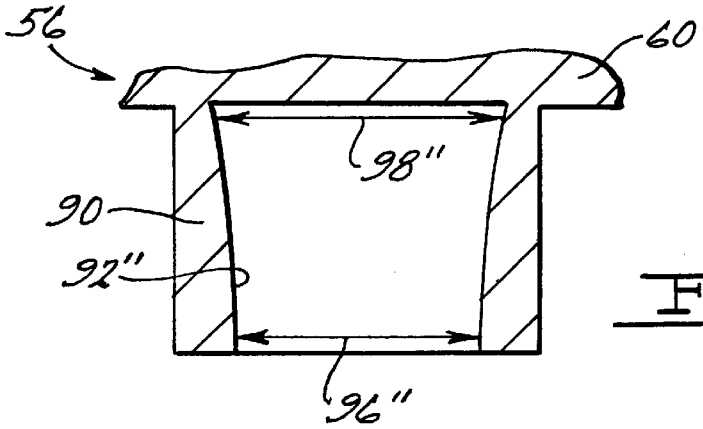
FIG. 5 is an enlarged cross-sectional view similar to FIG. 3 but illustrating a conical hub bore in accordance with another embodiment of the present invention.

Referring now to FIG. 5, bore 92" is illustrated. Bore 92" includes a first diameter 96" at its open end and a second diameter 98" at its closed end. The shape of bore 92" between diameters 96" and 98" is a curved line or an arcuate surface and diameter 96" is smaller than diameter 98'. Preferably, the difference between diameter 96" and 98" is between 0.0006 inches and 0.0010 inches.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a shell;

a first scroll member disposed within said shell, said first scroll member having a base plate and a first spiral wrap extending from said first base plate;

a second scroll member disposed within said shell, said second scroll member having a second spiral wrap, said second spiral wrap being intermeshed with said first spiral wrap;

a drive member for causing said scroll members to orbit relative to one another whereby said spiral wraps create pockets of progressively changing volume between a suction pressure zone and a discharge pressure zone;

a hub extending from said base plate of said first scroll member, said hub defining a bore within which said drive member is disposed, said bore having a first diameter located adjacent said base plate and a second diameter located distal from said base plate; and a bearing disposed within said bore of said hub in a press fit relationship with said hub, said first diameter of said bore being greater than said second diameter of said bore prior to said bearing being press fit within said bore.

2. The scroll machine according to claim 1, wherein said bore increases in size between said second diameter and said first diameter in a generally linear manner.

3. The scroll machine according to claim 1, wherein said second diameter of said bore extends into said bore for a specified distance.

4. The scroll machine according to claim 3, wherein said specified distance is sixty percent of a distance between said first and second diameters.

5. The scroll machine according to claim 3, wherein said bore increases in size between said second diameter and said first diameter in a generally linear manner.

6. The scroll machine according to claim 1, wherein said bore increases in size between said second diameter and said first diameter in a generally arcuate manner.

7. A scroll member comprising:

a base plate having a first side and a second side;

a spiral wrap extending from said first side of base plate; and a hub extending from said second side of said base plate, said hub defining a bore, said bore having a first diameter located adjacent said base plate and a second diameter located distal from said base plate, said first diameter being greater than said second diameter.

8. The scroll machine according to claim 7, wherein said bore increases in size between said second diameter and said first diameter in a generally linear manner.

9. The scroll machine according to claim 7, wherein said second diameter of said bore extends into said bore for a specified distance.

10. The scroll machine according to claim 9, wherein said specified distance is sixty percent of a distance between said first and second diameters.

11. The scroll machine according to claim 9, wherein said bore increases in size between said second diameter and said first diameter in a generally linear manner.

12. The scroll machine according to claim 7, wherein said bore increases in size between said second diameter and said first diameter in a generally arcuate manner.

* * * * *

UNITED STATES PATENT AND TRADEMARK OFFICE

CERTIFICATE OF CORRECTION

PATENT NO. : 6,179,591 B1
DATED : January 30, 2001
INVENTOR(S) : Harry Clendenin et al.

It is certified that error appears in the above-identified patent and that said Letters Patent is hereby corrected as shown below:

Column 4,
Line 43, "98" should be -- 98" --.

Signed and Sealed this

Sixth Day of November, 2001

*Attest:*

Nicholas P. Godici

NICHOLAS P. GODICI
*Acting Director of the United States Patent and Trademark Office*

*Attesting Officer*